United States Patent [19]

Seiler

[11] 4,290,446

[45] Sep. 22, 1981

[54] PUMP/EXCHANGER DEVICE

[76] Inventor: Alfred J. Seiler, 1700 Dumas-Vemont, Ville de Laval, Quebec, Canada

[21] Appl. No.: 51,127

[22] Filed: Jun. 22, 1979

[30] Foreign Application Priority Data

Apr. 20, 1979 [CA] Canada ..... 326042

[51] Int. Cl.[3] ..... F04F 5/24

[52] U.S. Cl. ..... 137/557; 137/205; 137/209; 137/565; 417/63; 417/183; 417/185

[58] Field of Search ..... 137/205, 209, 557, 565; 417/185, 63, 183, 120, 149

[56] References Cited

U.S. PATENT DOCUMENTS 1,545,700 7/1925 Schmidt ..... 137/625.41 X
2,141,427 12/1938 Bryant ..... 417/120
3,116,237 12/1963 Fontein et al. ..... 417/120 X
3,880,179 4/1975 Lenz et al. ..... 137/209 X

*Primary Examiner*—Gerald A. Michalsky
*Attorney, Agent, or Firm*—Alan Swabey; Robert Mitchell; Guy Houle

[57] ABSTRACT

Means adapted to receive a supply of compressed air and discharge the compressed air therefrom in a regulated manner via a selected port therein, control means within the means, for use in diverting the flow of the supply of compressed air within the means to thereby divert the air from the selected port to a further port in the means, whereby at least a partial vacuum condition is created in the selected port, allowing the ingress of air therethrough from without the means, the ingressed air mixing with the diverted air so as to be discharged through the further port.

6 Claims, 5 Drawing Figures

PUMP/EXCHANGER DEVICE

BACKGROUND OF THE INVENTION (a) Field of the Invention

The present invention relates to means, adapted to receive a supply of compressed air, for example, and selectively to discharge the compressed air therefrom in a regulated manner through a selected port in said means, or to alternatively cause air to ingress through said port from without said means.

The aforementioned means is deemed to have a wide application of uses in many fields. In one preferred embodiment of the invention it comprises a pump/exchanger. As such, it may be employed in a range of uses extending from ditch draining to drum filling and emptying of the same.

The present invention therefore particularly relates to apparatus for use in filling and emptying containers of liquid and especially containers such as oil drums and the like.

(b) Description of Prior Art

Various equipment is well known for use in filling and emptying drums, especially ones used in the chemical and petroleum industries.

A major drawback with the prior art drum emptying and filling equipment is it utilizes components such as for example, gear pumps or the like, containing many moving parts and which become worn-out and have to be replaced. Thus, costly maintenance and repair is involved. This is particularly true where for example, impurities and metal chips are in the liquid being handled. Such materials have an abrasive effect and accordingly destructive effect on the moving parts of the liquid handling equipment involved.

SUMMARY OF INVENTION

It is therefore a prime object of the present invention to provide an improved drum emptying and filling device which overcomes the aforementioned disadvantages.

It is a further prime object to provide a device of the type discussed which is safe to operate, compact, readily portable by hand and light-weight, which may be readily operated by unskilled personnel, where the operator of the device is never in contact with the liquids being transported by the equipment, this is especially important in the case of dangerous chemicals, and in particular where substantially no moving parts are involved and accordingly substantially little or no maintenance is involved.

It is yet a further important object to provide a device of the type discussed wherein such may be used with various liquids such as oil, water, chemicals, etc. and which may even, for example, contain impurities and abrasive materials such as metal chips, and in the case of one preferred embodiment, be capable of pumping the liquids at the rate of 200 liters (45 gallons) per minute.

It is yet a further important object of the present invention to provide a device of the type discussed wherein a minimum of time is required for reversing the operation of the equipment, i.e., to switch from filling a drum to emptying the drum and which involves the mere turning of a control lever to accomplish the same.

In one aspect of the present invention there is provided means adapted to receive a supply of compressed air and discharge said compressed air therefrom in a regulated manner via a selected port therein, control means within said means, for use in diverting the flow of said supply of compressed air within said means to thereby divert said air from said selected port to a further port in said means, whereby at least a partial vacuum condition is created in said selected port, allowing the ingress of air therethrough from without said means, said ingressed air mixing with said diverted air so as to be discharged through said further port.

BRIEF DESCRIPTION OF DRAWINGS

The invention is illustrated by way of example in the accompanying drawings wherein.

DESCRIPTION OF PREFERRED EMBODIMENTS

Figure 2:
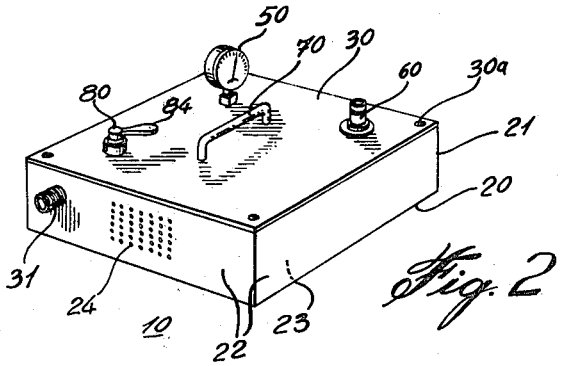
FIG. 2 is an oblique view of a preferred embodiment of a pump/exchanger in accordance with the present invention showing in particular a view of the top panel forming part of the housing for the pump/exchanger.

Referring now in detail to the drawings. There is shown in FIG. 2, as mentioned, a pump/exchanger in accordance with the present invention having a housing 10 comprising a box-like enclosure 20 and a top panel 30. Enclosure 20 and top panel 30 together provide a protection housing for the pump/exchanger components which are all mounted to the underside of top panel 30, as best seen in FIG. 3.

Enclosure 20 comprises in effect, an open top box 21 which is enclosed by a lid comprising top panel 30 and includes four sides 22, two of which only are seen in FIG. 2, and a base 23. Box 21 is constructed according to well known practice using suitable materials such as steel, the construction details of which have been omitted since it is deemed those skilled in the art are well familiar with such construction. Box 21 includes a series of apertures 24 for use in exhausting air from within housing 10. Box 21 is also apertured to receive portion 31 referred to hereinafter, and permits portion 31 to project therefrom. Top panel 30 is constructed of flat sheet material such as steel and is secured to enclosure 20 via flange portions (not shown) and screws 30*a*. Top panel 30 is suitably apertured to receive and mount a pressure-vacuum measuring gauge 50, port 60, carrying handle 70 and control means 80, substantially as shown in FIG. 2. Control means 80 comprises a two-way valve which, as readily seen in FIG. 1, rotates through an angle of 90° to open a passage therethrough in a pair of directions located at right angles to each other and on different planes to each other. Control means 80 is discussed in further detail hereinafter. Handle 70 is constructed from round bar material which has been suitably bent and welded to top panel 30.

Figure 3:
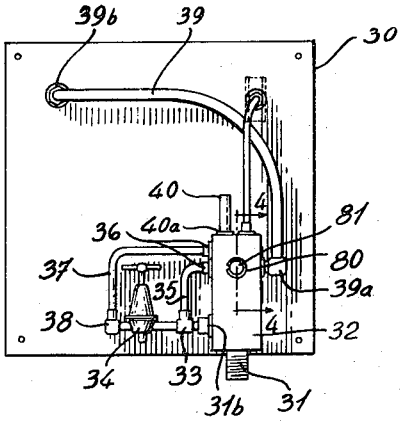
FIG. 3 is a view taken from within the housing shown in FIG. 2, showing the underside of the top panel with the pump/exchanger components mounted thereon.

Referring to FIG. 3, it will be seen the components comprising the pump/exchanger of the present invention are secured, by suitable means, to the underside of top panel 30, within the boundary edges of the top panel 30 except for a projecting portion 31, being an entry port of manifold 32. As will be further seen, a series of hoses are interconnected to manifold 32 by suitable means such as nipples, junction pieces or the like. The construction features of manifold 32 will be described in detail hereinafter with reference to FIGS. 1, 3 and 4.

Interconnected to manifold 32 is a "T" type fitting 33 from which is interconnected an air regulator 34 and air hose 35, the terminal end of which is interconnected to manifold 32 via nipple 36. A further hose 37 interconnects regulator 34 to manifold 32 via elbow 38 and further nipple 36. Extending from a side of manifold 32 is a hose 39 which interconnects manifold 32 and port 60 via elbows 39*a* and 39*b*, elbow 39*b* being securely anchored to top panel 30 by a clamp nut, being part of elbow 39*b*. Port 60 is adapted to receive a hose for interconnecting the unit to a drum which is to be selectively filled or emptied. A safety relief valve 40 is also secured to manifold 32 via an elbow 40*a*.

Referring now to the construction of the custom designed manifold 32. Basically, it is oblong block, rectangular in cross-section, made of steel or the like and includes various passageways, as diagramatically illustrated in FIG. 1. Passageway 31*a* extends throughout the length of the block and includes portion 31*c* and is intercepted by valve 80. A further passageway 60*d* extending completely from one side to the other of manifold 32 and which includes portion 60*e*, is located at 90° to passageway 31*a* and passes above the same on a plane common with passageway 50*b* into which is inserted, by screw connection, gauge 50 and relief valve 40.

Figure 4:
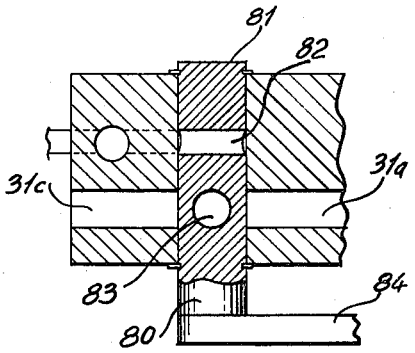
FIG. 4 is a part sectional view taken along line 4—4 in FIG. 3.

Control valve 80 comprises a solid round bar of material 81 such as brass, inserted and secured within manifold 32 by suitable means and adapted to rotate through an angle of 90° having a pair of holes 82 and 83 located therein for communicating respectively the passageways 31*a* with portion 31*c* and 60*d* with portion 60*e*. Valve 80 further includes a handle 84, as seen in FIGS. 2 and 4, for rotating round bar 81 and accordingly operating valve 80.

Figure 1:
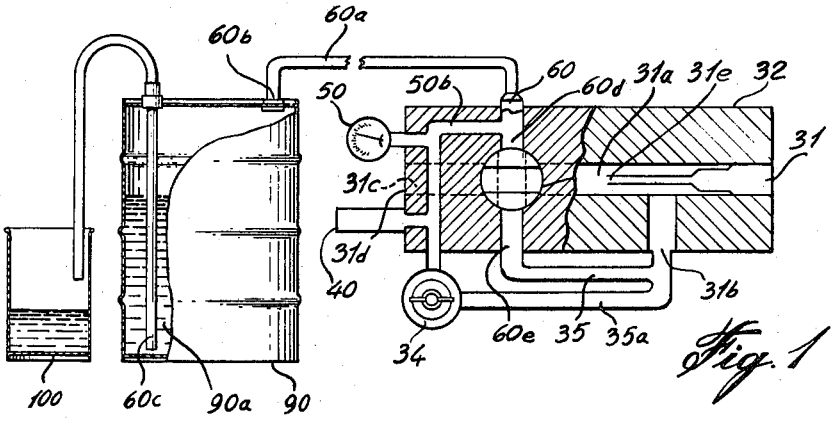
FIG. 1 is a diagrammatic view of a pump/exchanger in accordance with the present invention showing the same interconnected to a container.

Referring now to the operation of the pump/exchanger as shown in FIG. 2. Reference is now made to FIG. 1, which discloses diagramatically the arrangement of components discussed above in reference to FIG. 3. The component numerals shown in FIG. 3 correspond to like ones shown diagramatically in FIG. 1.

An air-line hose from a compressed air source (not shown) is interconnected to projecting portion 31 and positively secured thereto by suitable means so as to provide a source of compressed air to the pump/exchanger. The introduced compressed air passes along passageway 31*a* within manifold 32 and, depending upon the position of the control means 80, the air will either divert through port 31*b* and hose 35*a*, it also enters hose 35 but is prevented from passing to port 60 by the closed position of control means 80, or pass directly through portion 31*c* and out of port 31*d* finally escaping through apertures 24 in housing 10. When diverted through port 31*b*, is regulated by regulator 34, the air re-enters manifold 32, is monitored by the pressure gauge 50 and discharged from manifold 32 via port 60, from whence it travels through a hose 60*a* interconnecting a drum 90 with port 60.

Safety relief valve 40 is provided to ensure the air supplied to drum 90 does not exceed a selected pressure and accordingly protects the apparatus and drum from damage and the operator from injury. Thus, it will be realized from the foregoing, once regulator 34 has been adjusted so as to regulate the discharged air at a selected pressure and safety relief valve 40 has been set to relieve at a desired pressure, compressed air will enter drum 90, which is sealed except for the inlet port 60*b* and outlet pipe 60*c*, act upon the surface of liquid 90*a* thus forcing the liquid upwards and out through pipe 60*c* into container 100. Pipe 60*c* and hose 60*a* include quick disconnections to drum 90.

In order, for example, to remove liquid from container 100 and return it to drum 90, control valve 80 is simply rotated through 90° causing the compressed air to discharge through port 31*d* in manifold 32. The velocity and volume of the compressed air passing along passageway 31*a* and out through port 31*d* causes, because of the relative positions of inner porting 31*e* and port 31*b*, also because of the sizing of passageway 31*a*, porting 31*e* and port 31*b*, air to be sucked from drum 90 via hose 60*a*, passageway 60*d*, control 80, portion 60*e* and hose 35 through port 31*b*, mixed with the air discharging through porting 31*e* and discharged through port 31*d* and thus results in, at least a partial vacuum condition in, for example, port 60, hose 60*a* and consequently the drum 90. The resulting effect is liquid in container 100 is force up through pipe 60*c* back into drum 90. A valve (not shown) is located within hose 60*a* to prevent liquid in drum 90 entering manifold 32.

With regard to the selection of components comprising the present device. Referring again to FIG. 3, regulator 34 may be of any suitable type which is compatible with the air supply source, may be utilized. Various suitable commercial models are available. In the present described embodiment, a watt's* 0–60 lbs. maximum pressure model is used. Relief valve 40 may also be of any suitable type and selected from the many models available commercially such as the one shown in FIGS. 1 and 3 and which is set to relieve at a pressure within the safety limit of the equipment. The various hoses interconnecting the components as shown in FIGS. 1 and 3 may be of any suitable type such as clear plastic type, compatible with the air pressure and vacuum conditions present when operating the pump/exchanger.

*Trade Watts Fluid Power

Referring to FIG. 1, gauge 50 is, as indicated above, for use in measuring both pressure and vacuum conditions and the one illustrated in the Figures is a commercially available model which registers at least the operating range of the present pump/exchanger.

For ease of servicing, top panel 30 may be readily removed from enclosure 20 by withdrawing screws 30*a*. Following removal of screws 30*a*, top panel 30 is then lifted by the handle 70 and at the same time guiding projecting portion 31 out of the aperture in wall 22. When top panel 30 is removed, it accordingly removes with it the entire component assembly comprising the pump/exchanger, thus affording easy access to the components, as well illustrated in FIG. 3.

Figure 5:
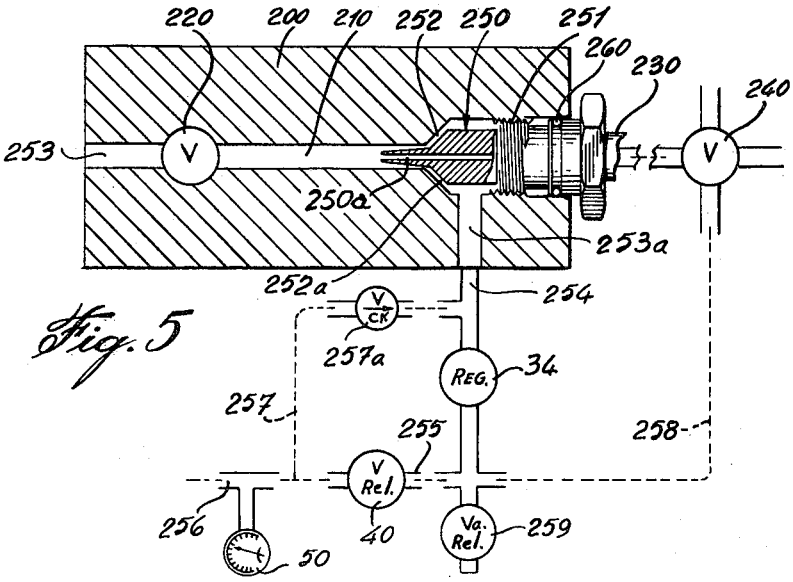
FIG. 5 is a diagramatic view of a further embodiment of a pump/exchanger in accordance with the present invention.

Reference is now made to FIG. 5 showing a further embodiment of a pump/exchanger in accordance with the present invention.

In this embodiment, there is provided a simple manifold 200 constructed from round bar material, such as steel, having a single passageway 210 extending throughout the length and along the central axis thereof and which is intercepted by a ball type valve 220 for controlling the passage of compressed air therethrough introduced via inlet portion 230 controlled by a further ball type valve 240. Positioned in one end of passageway 210 adjacent valve 240 is a plug like inlet port 250 secured in position therein by adjusting threads 251, used for advancing or retarding movement of inlet port 250 toward and away from a cone seat portion 252 in manifold 200. Inlet port 250 it will be seen includes a passageway 250*a* extending throughout the length and along the central axis thereof for carrying the compressed air admitted through valve 240.

Apart from port 253 used for exhausting the compressed air passing through passageway 210 from inlet port 250, manifold 200 also includes a furthe. port 253*a* for communicating passageway 210 with air-line 254. A gland 260 is used to provide a seal to prevent the escape of compressed air from manifold 200 passing through threads 251.

Unlike the embodiment disclosed in FIG. 1, regulator 34 and safety relief valve 40 and guage 50 are mounted remote from manifold 200 which as will be readily seen in FIG. 5, are interconnected by air-lines 254 and 255, the latter to provide an outlet 256 having means for interconnecting a hose such as 60*a* shown in FIG. 1 for connecting the pump/exchanger to a drum 90 to be filled or emptied.

A further air-line 257 interconnects air-lines 254 and 255 via a one way check valve 257*a*. A further air-line 258 interconnects air-line 255 with valve 240. A vacuum control 259 is mounted in line 255 as a safety device, discussed hereinafter.

Referring now to the operation of the pump/exchanger embodiment disclosed in FIG. 5 and which may be mounted and housed in a similar manner to that of the previously discussed embodiment. An air-line hose from a compressed air source (not shown) is interconnected to valve 240 and positively secured thereto by suitable means thereby to provide a source of compressed air to the pump/exchanger. With valve 240 open to admit the compressed air through passageway 250*a*, the compressed air enters passageway 210 and, depending upon whether valve 220 is open or closed, the air will either divert through port 253*a* or pass directly through valve 220 and out through port 253. When diverted through port 253*a*, the compressed air passes via line 254 to regulator 34, is regulated and enters line 255 passing eventually through outlet 256. Compressed air in line 254 is is prevented from passing along line 257 by ball check valve 257*a*. The pressure of the regulated compressed air is governed by safety valve 40. Valve 240 when opened to admit compressed air to passageway 250*a* closes line 258 and prevents the regulated compressed air from venting to atmosphere. Conversely, valve 240 when closing off the supply of compressed air, vents line 258 to atmosphere.

When ball valve 220 is opened so as to discharge the compressed air in passageway 210 through port 253, air is sucked through port 253*a* via cone seat portion 252. This in turn draws check ball valve 257*a* to an open position permitting air to be ingressed through port 256, the vacuum thus resulting in the air-lines 254, 255, 257, 258 and the connections of outlet 256, is governed by a pre-set vacuum control 259 positioned in line 255. Control 259 therefore ensures protection against damage to the pump/exchanger parts and the container being filled. Valve 240 has primarily been provided to ensure no pressure or vacuum remains in the pump/exchanger or containers connected thereto after the compressed air supply has been turned off.

An important feature of the pump/exchanger disclosed in FIG. 5 is the control provided by the design controlling the passage of air when it is sucked through port 253*a*. Threads 251 provide a micrometer like adjustment of the cone seating of portion 250. Accordingly, the gap 252*a* may be adjusted by fine tuning the threads 251. As in the case of the previously described embodiment, the sizing of the passageway 250*a* and the volume of air passing therethrough is important in order to obtain the desired results when operating the device as an exchanger. It is been found during experimentation with a prototype device built in accordance with the embodiment disclosed in FIG. 5, and while using a compressed air source of only 10 psi, 2 inch mercury vacuum has been obtained at port 256 and when using 100 psi, an 18 inch mercury vacuum has been obtained. These Figures are mentioned by way of example only.

From the foregoing, it will be realized the pump/exchanger as disclosed in FIG. 5 is a refined version of the embodiment disclosed in FIGS. 1–4 and operates in somewhat similar manner, and in which has been incorporated, in the circuitry, additional protection providing devices together with improved manifold design.

From the foregoing, it will be realized there is provided by the present invention, amongst the various other features discussed as objects of the invention, a very efficient light weight portable pump/exchanger device for respectively filling or emptying containers, and which possesses no moving parts such as gear pumps or the like. Furthermore, the present invention provides a device which can quickly switch from filling a container to emptying the same (even when, for example, drum 90 is located at a substantially different vertical level to that of container 100) and that all that is required to power the device, is a supply of compressed air, which in regard to the present described embodiments, would range for example from 10 to 125 psi, which is generally readily available in the various areas in which the invention is likely to be used.

I claim:

1. A combined pump/exchanger device comprising means defining an elongated passage having first and second ends, a port extending from said passage adjacent to but spaced from said first end, means within said passage at said first end for introducing a jet of compressed air into said passage axially of said passage at a point adjacent to but downstream of said port, said jet being of a cross section less than the cross section of said port, a valve in said passage intermediate said point and said second end, said second end being open, and an operating line connected to said port for coupling said device to an operating area, and said valve comprising means for selectively closing said passage and directing air under pressure to said operating line or opening said passage to said second end and creating a vacuum within said port and said operating line and causing an ingress of air, a regulator between said port and said operating line for controlling the pressure of the air discharged from said port into said operating line, a pressure-vacuum gauge coupled to said port for measuring either the pressure or vacuum condition in said port and a safety relief valve coupled to said port to ensure the air pressure in said port does not exceed a selected air pressure.

2. A device as defined in claim 1, wherein said device includes a manifold from said means defining said passage and said port, said means for introducing compressed air comprises an inlet portion positioned in said manifold.

3. A device as defined in claim 2 wherein said elongated passage has a termination within said manifold, said inlet portion in said manifold includes an inner port for discharging the compressed air within said manifold and positioned in selected spaced relation to said elongated passage termination, said port inner end and said elongated passage at said termination being of such selected sizing and said selected spaced relation being such that when said valve is positioned so as to discharge the compressed air from the manifold through said passage second end, air is drawn from without said manifold through said port and mixed with the compressed air passing through said elongated passage for discharge through said second passage end.

4. A combined pump/exchanger device comprising means defining an elongated passage having first and second ends, a port extending from said passage adjacent to but spaced from said first end, means within said passage at said first end for introducing a jet of compressed air into said passage axially of said passage at a point adjacent to but downstream of said port, said jet being of a cross section less than the cross section of said port, a valve in said passage intermediate said point and said second end, said second end being open, and an operating line connected to said port for coupling said device to an operating area, and said valve comprising means for selectively closing said passage and directing air under pressure to said operating line or opening said passage to said second end and creating a vacuum within said port and said operating line and causing an ingress of air, a regulator coupled to said port for controlling the pressure of the air discharged from said port, a pressure-vacuum gauge coupled to said port for measuring either the pressure or vacuum condition in said port, a safety relief valve coupled to said port to ensure the air pressure in said port does not exceed a selected air pressure, an adjustable vacuum control coupled to said port for selectively controlling vacuum in said port, a one way check valve permitting only the passage of said ingressed air from said operating line to said port and an on-off valve controlling the supply of compressed air to said passage and when set to an off position providing means for venting said passage relieving it of both air pressure or vacuum.

5. A device as defined in claim 4 wherein said device includes a manifold defining said passage and said port, said means for introducing a supply of compressed air comprises an inlet portion positioned in said manifold, an outlet port located remote from said manifold and interconnected with said port thereof via a first air-line, said regulator being located in said first airline and said outlet port being interconnected to said manifold port via a second air-line by-passing said regulator and having said one way check valve therein, a third air-line interconnecting said first air-line to said on-off valve, said on-off valve being movable from a first position to permit the passage of air to said passage and to a second position to prevent the passage of air to said passage means, said manifold includes means in said passage for adjusting the flow of air diverted from said second passage end to said port.

6. A device as defined in claim 5 wherein said means for adjusting the flow of air comprises a valve having a cone seat configuration through which the air passes, said configuration comprising two parts one of which is selectively moveable toward and away from the other to thereby increase or decrease the flow of air therethrough.

* * * * *